US005485830A

United States Patent [19]

Binzer

[11] Patent Number: 5,485,830

[45] Date of Patent: Jan. 23, 1996

[54] MODULAR FIREPLACE WITH INTERCHANGEABLE BURNER ASSEMBLY AND HEAT EXCHANGE INSERT

[76] Inventor: Lothar Binzer, 5721 124th Street, Surrey, B.C., Canada, V3X 3H3

[21] Appl. No.: 154,285

[22] Filed: Nov. 17, 1993

[51] Int. Cl.[6] ..... F24C 3/00

[52] U.S. Cl. ..... 126/512; 126/503; 126/524; 126/528

[58] Field of Search ..... 126/512, 531, 126/503, 524, 528, 529

[56] References Cited

U.S. PATENT DOCUMENTS

| | | | |
|---|---|---|---|
| 3,489,135 | 1/1970 | Astrella . | |
| 3,550,579 | 12/1970 | Baker . | |
| 3,552,377 | 1/1971 | Hodges . | |
| 3,741,194 | 6/1973 | Herron . | |
| 3,842,821 | 10/1974 | Juris . | |
| 4,099,511 | 7/1978 | McIntire et al. . | |
| 4,142,679 | 3/1979 | McKillop, Sr. . | |
| 4,259,941 | 4/1981 | Gerdes . | |
| 4,262,608 | 4/1981 | Jackson . | |
| 4,270,513 | 6/1981 | Mitchelson . | |
| 4,519,376 | 5/1985 | Schoeff et al. . | |
| 4,683,623 | 8/1987 | Cannata . | |
| 4,793,322 | 12/1988 | Shimek et al. . | |
| 4,817,585 | 4/1989 | Craver . | |
| 4,940,042 | 7/1990 | Moore et al. . | |
| 4,976,253 | 12/1990 | Beal et al. . | |
| 5,009,219 | 4/1991 | Liet et al. . | |
| 5,092,313 | 3/1992 | Blackburn et al. . | |
| 5,261,389 | 11/1993 | Trieb . | |
| 5,299,558 | 4/1994 | Binzer | 126/512 |
| 5,307,801 | 5/1994 | Schroeter et al. | 126/512 |
| 5,320,086 | 6/1994 | Beal et al. | 126/512 |

FOREIGN PATENT DOCUMENTS

| | | |
|---|---|---|
| 2650371 | 2/1991 | France . |
| 3102119 | 4/1991 | Japan . |

*Primary Examiner*—Carroll B. Dority
*Attorney, Agent, or Firm*—Flehr, Hohbach, Test, Albritton & Herbert

[57] ABSTRACT

A gas fireplace assembly for connection to a venting system comprises an outer shell for installation in the interior space of a building with the venting system extending into the outer shell. A fireplace unit is insertable within the shell that includes a combustion chamber. The combustion chamber includes a removable platform supporting a burner unit to be secured within the combustion chamber. The existing venting system is connected to the combustion chamber. The foregoing arrangement permits easy conversion of the fireplace assembly to different styles of decorative burner units or from a decorative gas burner to an efficient heating fireplace system and vice versa in a simple and economical manner.

11 Claims, 3 Drawing Sheets

MODULAR FIREPLACE WITH INTERCHANGEABLE BURNER ASSEMBLY AND HEAT EXCHANGE INSERT

FIELD OF THE INVENTION

This invention relates to a fireplace for installation in a home. In particular, this invention relates to a modular gas fireplace assembly having interchangeable decorative burner units or a heat exchanger unit whereby different configurations and types of gas fireplaces can be achieved in the same fireplace enclosure.

BACKGROUND OF THE INVENTION

In the current state of the gas fireplace industry, gas fireplaces are typically purchased and installed by developers and builders for incorporation into residential units which are later sold to a customer or which may be presold. Not surprisingly, the developer and builder is generally interested in installing the least expensive gas fireplace available. It is not uncommon for the ultimate purchaser of the home to be dissatisfied with the look of the unit installed by the builder. Often the homeowner will seek to replace the unit for a different configuration of gas fireplace. For example, a homeowner may prefer a particular style of decorative fireplace over the style which was installed by the builder. Similarly, the homeowner may prefer a heat efficient gas fireplace rather than a decorative gas fireplace. Typically, accommodating the homeowner's desires requires removal of the entire gas fireplace structure including the burners and the associated shell and fire box and ducting connectors. This is time-consuming, expensive and inconvenient.

SUMMARY OF THE INVENTION

The present invention provides a gas fireplace assembly that addresses the foregoing problem.

The present invention provides a gas fireplace assembly that enables conversion of an installed fireplace to different styles of interchangeable decorative gas burners or from a decorative gas burner to a heat efficient fireplace system and vice versa, and to do so as simply and economically as possible.

Accordingly, the present invention provides a gas fireplace assembly for connection to a venting system comprising:

- an outer shell for installation in the interior space of a building, the venting system extending into the outer shell;
- a fireplace unit insertable within the shell including a combustion chamber;
- a burner unit for generating heat by burning fuel;
- means for removably supporting and securing the burner unit within the combustion chamber; and
- means for communicating the combustion chamber with the venting system.

It is intended that the outer shell provides a universal fireplace receptacle that is installed by the builder with a venting system included. The homeowner makes the decision to purchase a particular fireplace unit that includes a combustion chamber and a particular burner unit. The fireplace unit or the burner unit can be easily changed to vary the appearance of the fireplace assembly as desired. It is also possible to upgrade from a decorative burner unit to a heat efficient system that includes a heat exchanger and a fan.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
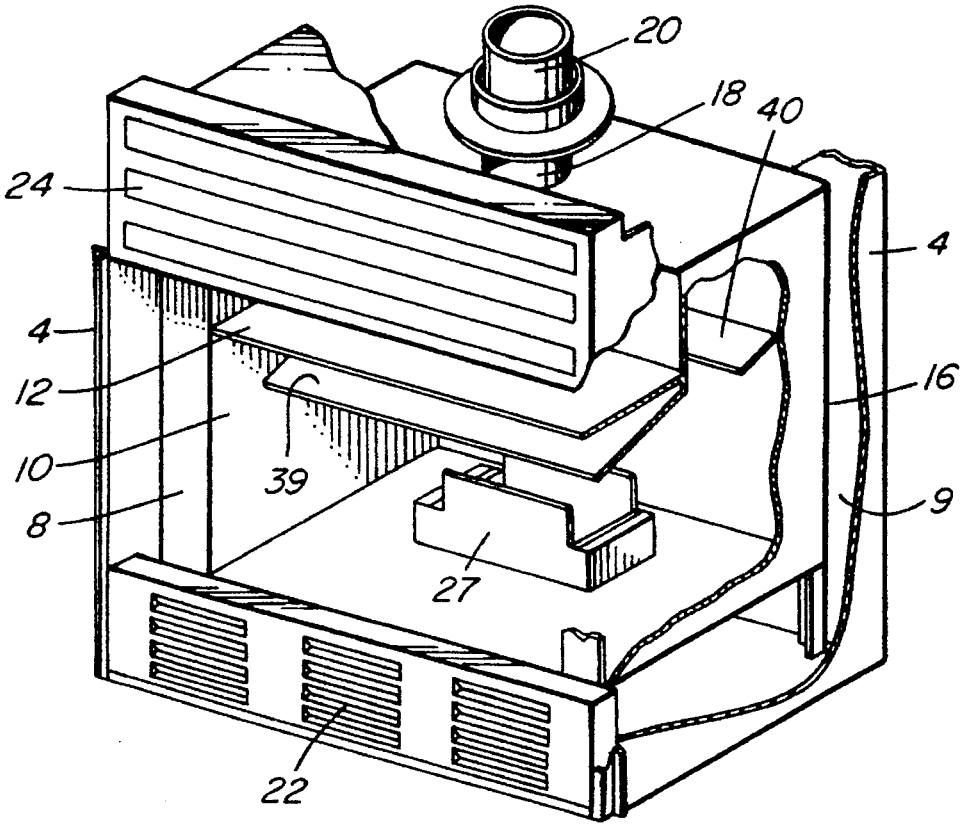
FIG. 1 is perspective view of a first embodiment of gas fireplace assembly fitted with a decorative burner.
Figure 2:
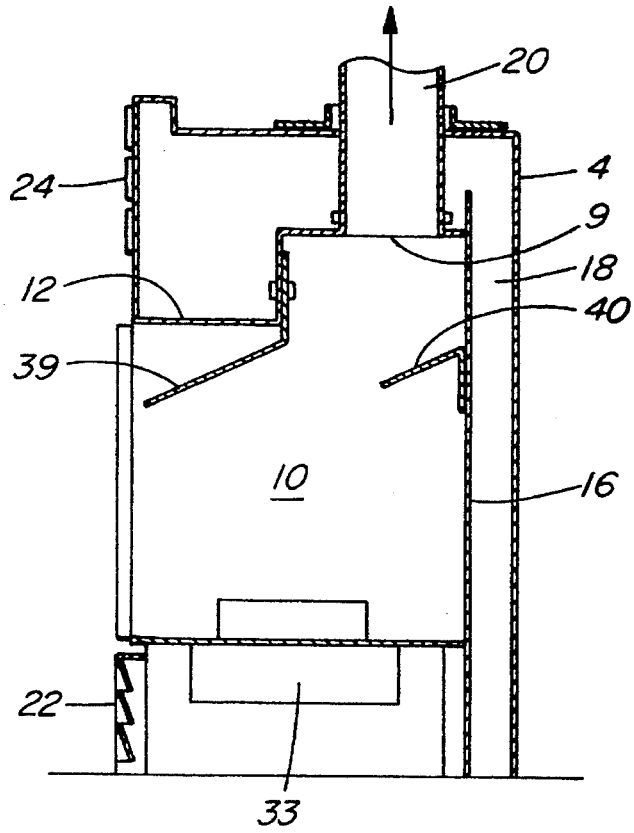
FIG. 2 is a cross-section view through the fireplace assembly of FIG. 1.
Figure 3:
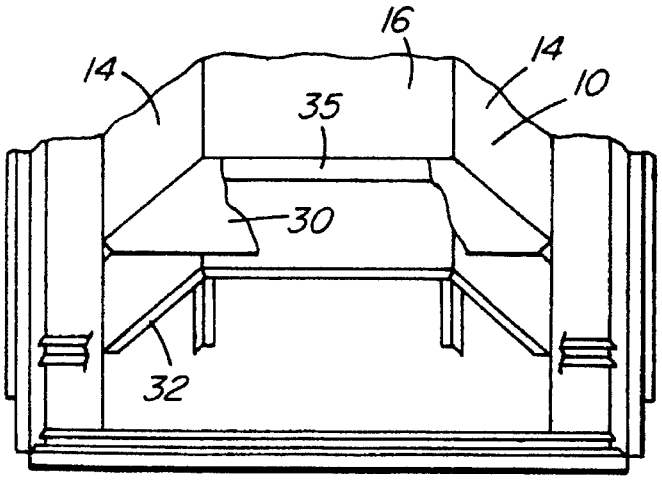
FIG. 3 is a detail view of the fireplace assembly of FIG. 1 showing the interchangeable burner unit and its mounting platform and the shelf to support the platform.

Referring to FIGS. 1–3, there is shown a first embodiment of the gas fireplace assembly of the present invention. The illustrated assembly is intended to provide a decorative fireplace within an interior space of a building.

The fireplace assembly 2 is formed from an outer shell or liner 4 that is installed in a pre-formed cavity in a wall of the building. Shell 4 would normally be installed by the builder to pinpoint the location of the fireplace to be installed. A conventional venting system such as a B-vent duct would also be installed to extend into the cavity defined by the liner. The builder is then free to finish the building so that the eventual home owner can select and install a gas fireplace assembly of his own choosing.

A fireplace unit 8 is insertable within shell 4. Fireplace unit 8 is formed from a series of sheet metal panels that are fastened together to define a combustion chamber 10. There is a top panel 12 and side panels 14. Top panel is preferably formed with a raised rectangular chamber 9 defining a draft hood for the fireplace unit. The side panels may be of any general configuration, but in the illustrated embodiment panels 14 are angled inwardly to converge toward the rear of the fireplace unit when inserted within shell 4. A rear panel 16 extends between side walls 14. As best shown in FIG. 2, rear panel 16 is spaced a small distance away from outer shell 4 when fireplace unit 8 is installed. Top panel 12 is formed with means for communicating the combustion chamber with the venting system in the form of an aperture 18 adapted for connection to a B-vent duct 20. The front face of the combustion chamber is open. A metal fire screen (not shown) or folding or sliding glass doors (not shown) can be installed across the open front face. As best shown in FIG. 1, bottom and top grilles 22 and 24, respectively, and other finishing pieces are installed above and below the open front face to provide a finished appearance.

A burner unit 27 for generating heat by burning gas is installable within combustion chamber 10. There are means for removably supporting and securing burner unit 27 in the combustion chamber comprising platform 30 and shelf 32. Shelf 32 extends inwardly into combustion chamber 10 from side panels 14 and rear panel 16 and is formed a distance up from the floor of the fireplace cavity. The purpose of shelf 32 is to act as a support for burner unit 27 when mounted on platform 30. When installed in place on shelf 32, platform 30 forms the raised floor of the combustion chamber. Platform 30 is shaped to fit snugly between the side panels and rear panel of combustion chamber 10. Preferably, platform 30 is secured in place by a number of removable fasteners 35 that extend through platform 30 into shelf 32. Burner unit 27 is a conventional gas burning unit that is mounted to platform 30. Burner unit 27 is supplied with artificial logs to create the decorative appearance of a real log fire. Burner unit 27 also includes a gas control valve 33 that extends through an aperture 28 in the platform into the space below the platform. Control valve 33 is connected to a gas line 36 extending into the space below platform 30. Bottom grill 22 is removable to provide access to control valve 33.

Referring to FIG. 3, when burner unit 27 is operating, room air is drawn through bottom grill 22 into the space below platform 30 and into combustion chamber 10. Combustion fumes escape upwardly through combustion chamber 10 and into duct 20 for exhaust to the exterior. Baffles 39 and 40 are positioned adjacent aperture 18 and act to deflect downdrafts away from the burner unit 27.

The gas fireplace assembly of the first embodiment is adapted for removably receiving various interchangeable decorative burner units 27 within combustion chamber 10. Changing a burner unit involves disconnecting gas lines and removing the doors at the front face of the combustion chamber. Fasteners 35 are removed to allow platform 30 and attached burner unit 27 to be removed as a single unit. A different style of burner with its own attached platform can then be inserted into place according to the homeowner's desires.

Figure 4:
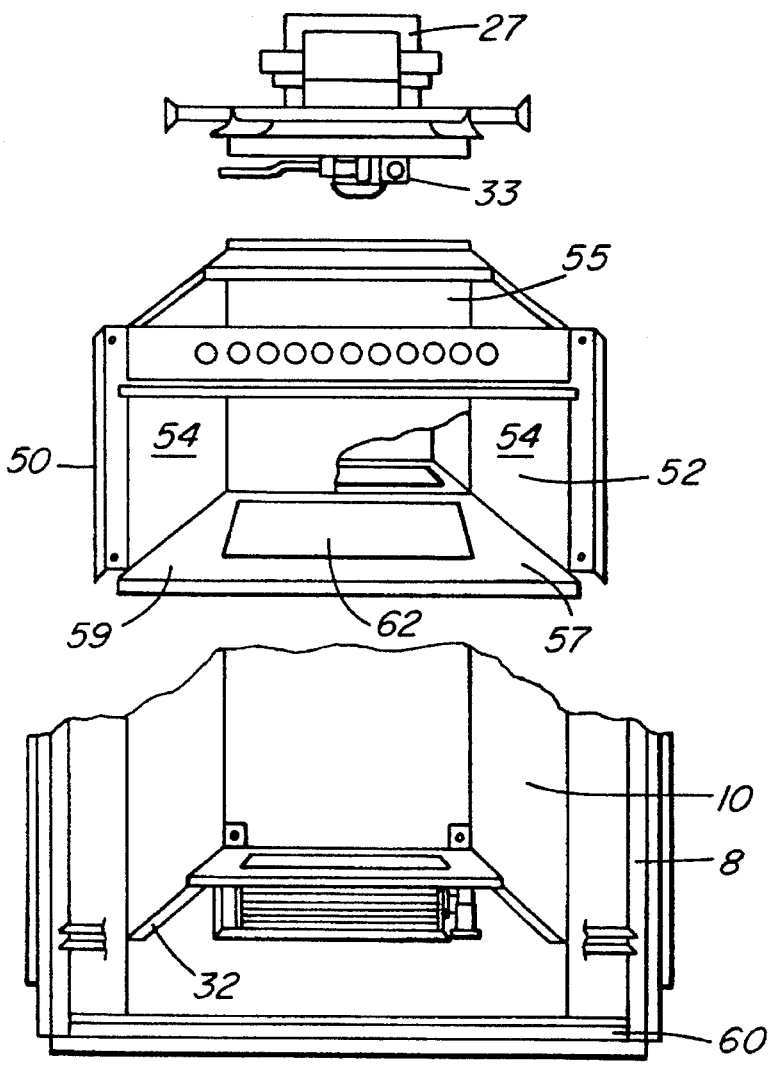
FIG. 4 is an exploded view of a second embodiment of the present invention that employs a heat exchanger insert.
Figure 5:
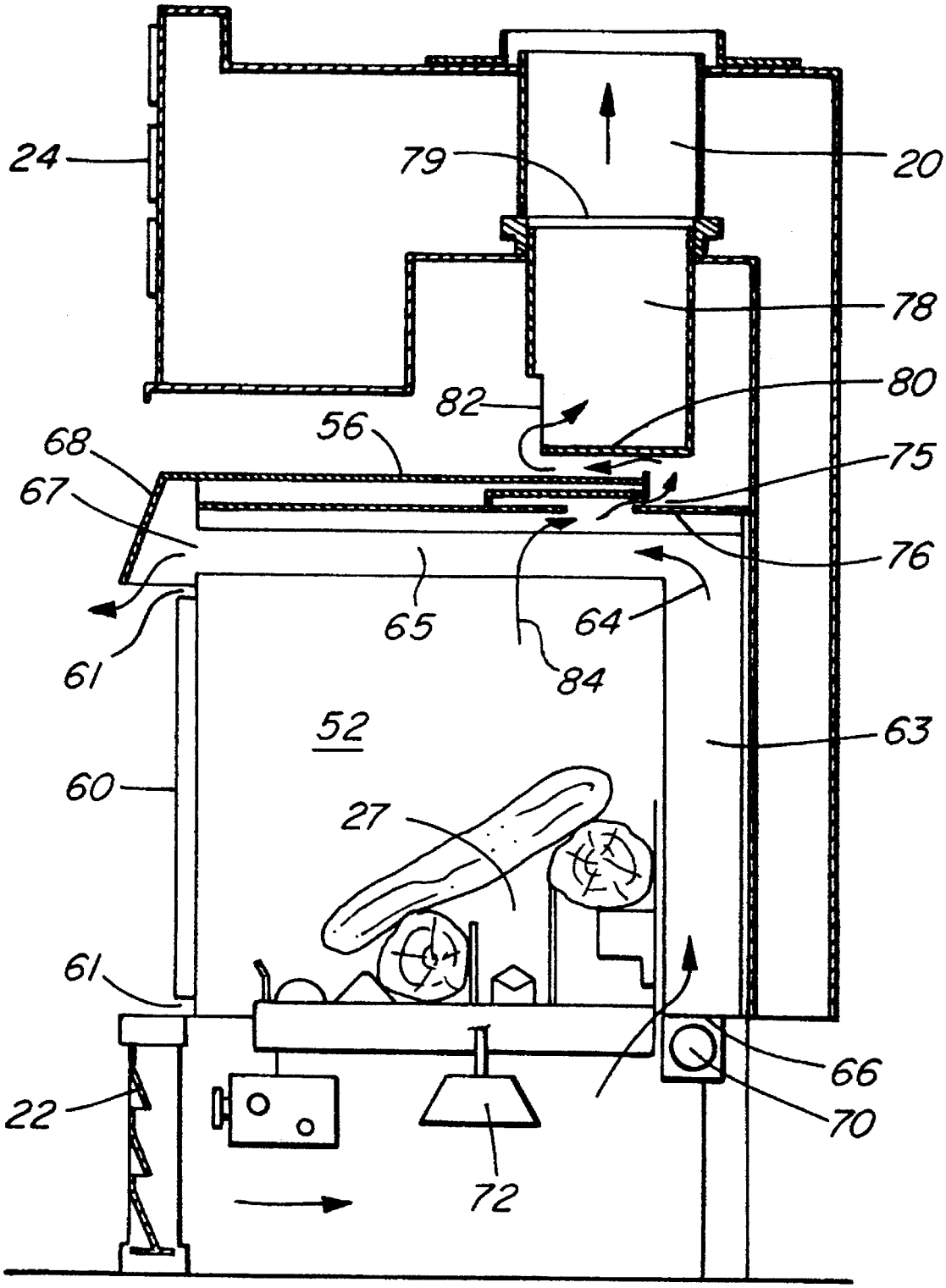
FIG. 5 is a cross-section view through the fireplace assembly of FIG. 4.

FIGS. 4 and 5 show a second embodiment of the present invention comprising a gas fireplace assembly configured as a heating fireplace with heat exchange means mounted in combustion chamber 10 of fireplace unit 8. In this configuration, the fireplace assembly is a high efficiency heating unit. As best shown in FIG. 4, the second embodiment uses the same fireplace unit 8 as the first embodiment. In this second embodiment, burner unit 27 is mounted in a heat exchanger insert 50 adapted to be installed within combustion chamber 10 of fireplace unit 8. Shelf 32 is used to secure and support insert 50.

Heat exchanger insert 50 comprises an enclosure having its own combustion chamber 52. Insert 50 is formed from sheet metal panels that includes side panels 54, a rear panel 55, a top panel 56 and a base panel 57. The insert has an open front face 59. Mounting brackets 61 are provided to position a glass panel 60 across open front face 59. The insert is shaped to correspond to the combustion chamber 10 of fireplace unit 8. There is an aperture 62 in base 57 to accommodate the control valve 33 of burner unit 27. Base 57 rests on shelf 32 and is secured in place by removable fasteners.

Adjacent rear panel 55 of the heat exchanger insert there is formed an additional passage 63 that acts as a passage for heat exchange. From inlet 66, passage 63 extends up the rear of the insert and into a plurality of tubular passages 65 the extend through combustion chamber 52 adjacent top panel 56 and terminate in outlets 67 adjacent open front face 59.

In operation of the fireplace assembly, burner 27 heats the air in combustion chamber 52 and the wall panels of the heat exchanger insert. As shown by arrow 64 in FIG. 5, interior room air flows through bottom grille 22 to inlet 66. The air is heated as it passes up over the heated rear panel of the combustion chamber in passage 63 and through heated tubular passages 65. The heated air is delivered back into the interior through outlets 67. A hood 68 can be positioned over outlets 67.

A fan unit 70 can be provided at inlet 66 to force air through passages 63 and 65 of the heat exchanger insert. Fan unit 70 is mounted on shelf 32 prior to installing the heat exchanger insert adjacent the rear panel 16 of fireplace unit 8. When the heat exchanger insert is installed the rear of the insert rests against the rear panel 16 of fireplace unit 8 and inlet 66 of air passage 63 is automatically aligned over fan unit 70. A seal can be provided about inlet 66 that is engaged by insert 50 to from a good seal between the fan unit and the air passage. The insert may be secured in place by means of fasteners about the open face of the insert or by other suitable means.

The speed of fan unit 70 is regulated by a control unit 72 that includes a temperature sensor that measures the air temperature in combustion chamber 52.

Heat exchanger insert 50 is formed with an aperture 75 in top panel 56 to permit escape of combustion gases to the space in fireplace unit 8 above heat exchanger insert 50. Aperture 75 is provided with a baffle arrangement 76 to prevent downdrafts. In addition, to further protect against downdrafts, a cylindrical collar 78 extends between B-vent 20 and the top panel 56 of the heat exchanger insert. Collar 78 has an open top end 79 in communication the B-vent 20 and a closed lower end 80 that rests atop panel 56. Collar 78 is formed with a rectangular slot 82 that faces toward open front face of the installed fireplace assembly. As best shown by arrow 84 in FIG. 5, combustion gases produced in combustion chamber 52 travel upwardly over heat exchange passages 65, through aperture 75 and into collar 78 for exhaust to the exterior of the building.

It will be readily apparent by comparing the cross-sectional views in FIGS. 2 and 5 of the decorative and heating fireplace assemblies of the present invention that baffles 39 and 40 have to be removed from a decorative fireplace assembly prior to installing heat exchanger insert 50.

Although the present invention has been described in some detail by way of example for purposes of clarity and understanding, it will be apparent that certain changes and modifications may be practised within the scope of the appended claims.

I claim:

1. A modular gas fireplace assembly for connection to a venting system comprising:

an outer shell into which the venting system extends;

a fireplace unit insertable within the shell having an open front, a pair of side walls, a rear wall and a roof with first predetermined dimensions;

means for generating heat comprising a heat exchange unit comprising an insert insertable within the fireplace unit having a floor formed by the platform, an open front, a pair of sidewalls, a rear wall, and a roof, and means forming at least one heat exchange air passage extending adjacent the insert, and a platform with an attached gas burner, means for communicating the gas burner with a source of gas, and a control valve for the gas burner;

a shelf formed in the fireplace unit to support the platform to define a floor with a second predetermined dimension for the fireplace unit; and means for communicating the fireplace unit with the venting system;

whereby the second predetermined dimension of the shelf and the first predetermined dimensions of the fireplace unit accommodate removable receipt of the platform in a set position that automatically locates the gas burner for safe operation within the fireplace unit to permit interchange of different means for generating heat by insertion of different platforms.

2. A gas fireplace assembly as claimed in claim 1 in which the means forming at least one heat exchange air passage comprises a passageway that extends up the rear wall of the insert and separates into a plurality of tubular passages extending through the insert and adjacent the roof of the insert, the passageway having an inlet to receive air for heating and an outlet to deliver heated air.

3. A gas fireplace assembly as claimed in claim 2 including fan means positioned at the inlet.

4. A gas fireplace assembly as claimed in claim 3 in which the fan means comprises a fan unit that is received and supported on the shelf below the platform.

5. A gas fireplace assembly as claimed in claim 1 including an aperture formed in the roof of the insert to communicate with the venting system.

6. A gas fireplace assembly as claimed in claim 5 including baffle means formed in the aperture to prevent downdrafts from entering the insert.

7. A gas fireplace assembly as claimed in claim 5 including collar means to extend the venting system to adjacent the aperture.

8. A gas fireplace assembly as claimed in claim 3 including temperature sensing means to control the fan means.

9. A gas fireplace assembly as claimed in claim 1 including baffle means in the fireplace unit positioned to prevent backdrafts through the venting system into the fireplace unit.

10. A gas fireplace assembly as claimed in claim 1 in which the fireplace unit is formed from sheet metal.

11. A gas fireplace assembly as claimed in claim 1 in which the means for communicating the fireplace unit with the venting system comprises an aperture in the fireplace unit adapted for connection to the venting system.

* * * * *